US007398963B2

(12) United States Patent
Hills

(10) Patent No.: US 7,398,963 B2
(45) Date of Patent: Jul. 15, 2008

(54) APPARATUS AND METHOD FOR DIFFUSED AERATION

(76) Inventor: Blair H. Hills, 1648 Woodvale Dr., Charleston, WV (US) 25314

( * ) Notice: Subject to any disclaimer, the term of this patent is extended or adjusted under 35 U.S.C. 154(b) by 83 days.

(21) Appl. No.: 11/157,652

(22) Filed: Jun. 21, 2005

(65) Prior Publication Data

US 2005/0280167 A1 Dec. 22, 2005

Related U.S. Application Data

(60) Provisional application No. 60/581,697, filed on Jun. 21, 2004.

(51) Int. Cl.
*B01F 3/04* (2006.01)

(52) U.S. Cl. ..... 261/87; 261/91; 261/93

(58) Field of Classification Search ..... 261/84, 261/87, 91, 93, 123
See application file for complete search history.

(56) References Cited

U.S. PATENT DOCUMENTS

| | | | | |
|---|---|---|---|---|
| 2,063,301 | A * | 12/1936 | Durdin, Jr. | 261/83 |
| 2,293,183 | A | 8/1942 | Walker | |
| 3,532,327 | A | 10/1970 | Landberg | |
| 3,606,273 | A * | 9/1971 | Johnson | 366/263 |
| 3,630,498 | A | 12/1971 | Bielinski | |
| 3,643,403 | A | 2/1972 | Speece | |
| 3,677,528 | A | 7/1972 | Martin | |
| 3,771,724 | A * | 11/1973 | Rose et al. | 239/221 |
| 3,775,307 | A | 11/1973 | McWhirter et al. | |
| 3,810,546 | A * | 5/1974 | Oxenham | 210/242.3 |
| 3,856,272 | A | 12/1974 | Ravitts | |
| 3,911,064 | A | 10/1975 | Whirter et al. | |
| 4,064,403 | A | 12/1977 | Miller | |
| 4,095,918 | A | 6/1978 | Mouton, Jr. et al. | |

(Continued)

FOREIGN PATENT DOCUMENTS

| | | |
|---|---|---|
| JP | 04197496 | 7/1992 |

OTHER PUBLICATIONS

"Deep Tank Aeration with Blower and Compressor Considerations," *Aeration: Principles and Practice*, pp. 147-197, 2005.

(Continued)

*Primary Examiner*—Scott Bushey
(74) *Attorney, Agent, or Firm*—Matthew W. Gordon, Esq.; Alan G. Towner, Esq.; Pietragallo Gordon Alfano Bosick & Raspanti, LLP

(57) ABSTRACT

An apparatus for mixing gas and liquid is disclosed. The apparatus includes a draft tube having a gas inlet, a liquid inlet, a gas-liquid outlet, and an impeller rotatably mounted within the draft tube. The gas can be entrained into the liquid by rotation of an impeller having a low pitch ratio, such as less than 1:1. The impeller can have a diameter than is greater than the axial length of the impeller and includes at least one blade extending at least 30° around an axis of rotation of the impeller. Liquid turning vanes can also be positioned external to the draft tube to rotate liquid entering the draft tube in a direction opposite the direction of rotation of the impeller. The impeller can be constructed to create a reduced pressure zone, which directs gas axially downward within the draft tube upon rotation of the impeller.

22 Claims, 17 Drawing Sheets

U.S. PATENT DOCUMENTS

| | | | | | |
|---|---|---|---|---|---|
| 4,231,974 | A | * | 11/1980 | Engelbrecht et al. | 261/87 |
| 4,242,289 | A | | 12/1980 | Blum | |
| 4,259,267 | A | * | 3/1981 | Wang | 261/93 |
| 4,318,871 | A | * | 3/1982 | Mentz | 261/120 |
| 4,371,480 | A | | 2/1983 | Vos | |
| 4,459,030 | A | * | 7/1984 | Weetman | 366/262 |
| 4,465,645 | A | * | 8/1984 | Kaelin | 261/87 |
| 4,512,936 | A | | 4/1985 | Oshima et al. | |
| 4,519,715 | A | | 5/1985 | Golobic et al. | |
| 5,043,104 | A | | 8/1991 | Stirling | |
| 5,112,192 | A | | 5/1992 | Weetman | |
| 5,431,860 | A | | 7/1995 | Kozma et al. | |
| 5,525,269 | A | | 6/1996 | Connolly et al. | |
| 5,536,875 | A | * | 7/1996 | Roby et al. | 562/412 |
| 5,711,902 | A | | 1/1998 | Hsu | |
| 5,755,976 | A | | 5/1998 | Kortmann | |
| 5,916,491 | A | | 6/1999 | Hills | |
| 5,921,745 | A | | 7/1999 | Round et al. | |
| 5,925,290 | A | | 7/1999 | Hills | |
| 6,017,020 | A | | 1/2000 | Baughman | |
| 6,077,424 | A | | 6/2000 | Katsukura et al. | |
| 6,135,430 | A | | 10/2000 | Bergman, Jr. et al. | |
| 6,145,815 | A | | 11/2000 | Cheng et al. | |
| 6,273,402 | B1 | | 8/2001 | Cheng | |
| 6,461,500 | B1 | * | 10/2002 | Hoage et al. | 210/150 |
| 6,877,959 | B2 | | 4/2005 | McWhirter | |

OTHER PUBLICATIONS

"Surface and Mechanical Aeration," *Aeration: Principles and Practice*, pp. 199-240, 2005.

J. R. McWhirter et al., "Oxygen Mass Transfer Fundamentals of Surface Aerators," *Ind. Eng. Chem. Res.*, vol. 34, No. 8, 1995, pp. 2644-2654.

*Patent Abstracts of Japan*, JP 04197496 (N II T KK), Jul. 17, 1992.

* cited by examiner

APPARATUS AND METHOD FOR DIFFUSED AERATION

CROSS REFERENCE TO RELATED APPLICATION

This application claims the benefit of U.S. Provisional Application No. 60/581,697 filed Jun. 21, 2004, which is incorporated herein by reference.

FIELD OF THE INVENTION

The present invention relates generally to gas-liquid mixers, and more particularly to a gas-liquid mixer that achieves diffused aeration by a mechanical aerator.

BACKGROUND INFORMATION

Gas-liquid mixing systems are conventionally used for many purposes, such as the mass transfer of gases into and/or out of liquids. Oxidation and reduction reactions often require that a gas, such as oxygen, chlorine or hydrogen, be mixed with liquids in the presence of solids. Unwanted gases dissolved in liquids can be stripped from the liquid by mixing a desired gas into the liquid. Direct contact heating of a liquid requires that a hot gas be mixed into a liquid, and, in some instances, the pH of a liquid can be adjusted by mixing a gaseous acid or base into the liquid.

For example, oxygen gas is often mixed with various liquids. Oxygen gas can be mixed with activated sludge to aerate waste material and assist in digestion, it can be used to oxidize carbon, sulfur and/or nitrogen containing material in a liquid, it can also be mixed with liquids containing organic compounds to oxidize the organic compounds into alcohols, aldehydes and acids, or it can be mixed with hydrometallurgical process liquids to achieve various desired effects. Oxygen gas can also be mixed with liquids to reduce nitrogen-containing compounds into nitroso-containing materials, nitrites and/or nitrates. Oxygen gas can be mixed with liquids to reduce sulfur-containing compounds into disulfides, sulfoxides and/or sulfates.

The formation of hydrogen sulfide can occur in any aquatic based system containing sulfates in which the dissolved oxygen does not meet the oxygen demand. Even small quantities of hydrogen sulfide can produce objectionable odors thereby necessitating that oxygen be mixed into the liquid. Industrial and municipal wastewater can also be treated by biological treatment techniques in which aerobic microorganisms convert contaminants into carbon dioxide gas and biomass. Sufficient oxygen must be provided to the aerobic organisms in order to carry out the necessary biological processes, chemical oxidation and/or fermentation processes.

Hydrogen gas can also be mixed with various liquids or liquid solid mixtures. For example, hydrogen gas can be used to saturate carbon-carbon double bonds and to reduce nitro and nitroso compounds in organic materials. Hydrogen gas can also be mixed into liquids present in vegetable oils processing, yeast production, vitamin C production, coal liquefaction, and the production of other types of unsaturated organic liquids. Chlorine gas can also be mixed with organic and inorganic liquids. Carbon monoxide gas can also be mixed with liquids containing organic compounds. In each of these examples, gas can be mixed into a liquid to dissolve and react with the liquid and/or liquid solid mixture to achieve various desired effects.

Conventional gas-liquid mixing systems can be typically classified as either surface aerators or diffused gas delivery systems. Diffused gas delivery systems that require gas compression typically comprise coarse, medium or fine bubble diffusers, liquid motive force venturi, jet type mixers that require large pumping systems, or agitators that utilize hollow members or spargers positioned to deliver pressurized gas to a mixing zone. Diffused gas delivery systems that do not require gas compression equipment typically comprise self-inducing systems such as venturi systems, vortex systems, and rotor/stator pitched blade turbine reactors.

In traditional systems, the delivery of gas to the desired liquid depth requires the use of fans, blowers, compressors, venturi or vortex systems to entrain the gas or compress the gas to a pressure equal to or greater than the static head at the desired liquid depth. Some traditional systems deliver compressed gas to a porous material, such as a fine hole matrix, mesh or membrane, that is permanently mounted near the bottom of a tank to disperse gas. However, these porous materials are easily fouled and can become blocked when placed in dirty liquids, liquids having a high particulate concentration or high soluble mineral concentration. Fouled materials reduce efficiency, increase operational energy cost, and increase bubble size. Porous materials can also stretch over time, thereby increasing hole size and bubble formation diameter, or harden, thereby causing increased pressure. Larger bubbles, caused by larger hole size, increased pressure or fouling, reduce the available gas-liquid surface area, which reduces the overall Standard Aeration Efficiency (SAE). The efficiency of fouled, blocked or stretched materials can drop to only 30% to 40% of their stated SAE in clean water.

To remedy the higher energy costs associated with fine bubble diffusers, additional energy, maintenance and/or replacement equipment is often needed. Periodic cleaning and maintenance often involve expensive and hazardous HCl injections into the diffuser system and/or the emptying of the aeration vessel followed by physical cleaning. Plastic membranes must be periodically changed, which increases labor, materials and processing costs associated with an aeration system shut-down during installation.

Non-mechanical diffused gas-liquid mass transfer systems, especially those using fine bubble diffusers, can deliver standard aeration efficiency (SAE) of 1.6 to 7 kilograms of dissolved oxygen (DO) from air per kilowatt-hour (kg/kWh) in clean water (SAE-ANSI/ASCE Standard 2-91). Their efficiency, even when clean, is frequently reduced by the intensity of the liquid mixing. The efficiency of a non-mechanical diffused gas-liquid mass transfer system in dirty or contaminated liquid can be only 40 to 50% of the clean water efficiency of the system.

Some examples of diffused aeration systems that are not based on fine bubble diffusers include traditional mechanical diffused aeration systems. Traditional diffused aerator systems can include a high speed prop mixer and a regenerative blower, such as the commercially available Aire-$O_2$ Triton®, large liquid mixers systems using a gas compressor, such as the draft tube aeration system commercially available from Philadelphia Mixers Corp., and jet aeration systems using a gas/liquid mixing jet, a liquid pump and a gas compression device, such as the system commercially available from US Filter Corporation.

Other traditional mechanical diffused aeration systems do not use a compressor, however, these systems require a vortex or a venturi system to create gas pockets at some depth below the surface of the liquid. Examples of these traditional mechanical diffused aeration systems include: U.S. Pat. No. 6,273,402 for a Submersible In-Situ Oxygenator, U.S. Pat. No. 6,145,815 for a System for Enhanced Gas Dissolution Having a Hood Positioned Over the Impeller with Segregating Rings, U.S. Pat. No. 6,135,430 for Enhanced Gas Dissolution, U.S. Pat. No. 5,916,491 for Gas-Liquid Vortex Mixer and Method, and U.S. Pat. No. 5,925,290 for Gas-Liquid Venturi Mixer, each of which are incorporated by reference herein.

In each of these traditional gas-liquid mixing systems that do not require a compressor, either liquid pumps or mixers are required to create high liquid velocities within the system. In order to introduce gas into the system, a velocity head must be created that is greater than the static head at the desired liquid depth at which the gas is introduced to the liquid. To overcome this static head, traditional systems require a liquid moving device, such as an axial or radial liquid pump or mixer, to accelerate a volume of liquid at a high velocity within a tank or holding area.

Conventional mechanical diffused air systems typically have an SAE of from 0.4 to 1.6 kg/kWh. Typically, low speed surface aerators give the highest SAE for mechanical aeration systems. These systems typically state an SAE of from 1.9 to 2.5 kg/kWh. However, surface aerators achieve low gas utilization and require large volumes of gas to be mixed with liquid, causing a high rate of off-gassing, which strips volatile organics from the liquid into the gas.

The present invention has been developed in view of the foregoing and to remedy other deficiencies of related devices.

SUMMARY OF THE INVENTION

The present invention relates to an apparatus for mixing gas and liquid. An impeller having a low pitch ratio can be used to accelerate a liquid at a relatively low axial velocity to entrain gas into the liquid by rotating the impeller at a relatively high angular velocity. The low pitch ratio impeller can have a variable pitch ratio and can have a diameter that is greater than the axial length that a blade of the impeller progresses by tracing the pitch of an impeller blade through a 360° rotation of the impeller. The impeller can have at least one blade extending at least 30° around an axis of rotation of the impeller. Liquid turning vanes can also be positioned external to a draft tube to rotate liquid entering the draft tube in a direction that is counter to the direction of rotation of the impeller. The impeller can also be configured to create a reduced pressure zone, which distributes gas through the pumped liquid and directs gas axially downward within the draft tube upon rotation of the impeller.

An aspect of the present invention is to provide an apparatus for mixing gas and liquid, comprising a draft tube having a liquid inlet, a gas inlet, and a mixed gas/liquid outlet, and an impeller rotatably mounted at least partially within the draft tube, wherein the at least one impeller has a pitch ratio of less than 1:1.

Another aspect of the present invention is to provide an apparatus for mixing gas and liquid, comprising a draft tube having a liquid inlet, a gas inlet, and a mixed gas/liquid outlet, and an impeller having a diameter and an axial length, rotatably mounted at least partially within the draft tube, wherein the diameter of the impeller is greater than the axial length of the impeller, the impeller comprising at least one blade extending at least 30° around an axis of rotation of the impeller.

Another aspect of the present invention is to provide an apparatus for mixing gas and liquid, comprising a draft tube having a liquid inlet, a gas inlet, and a mixed liquid/gas outlet, at least one impeller rotatably mounted at least partially within the draft tube, and a plurality of liquid turning vanes, positioned predominantly outside an inside diameter of the draft tube and adjacent the liquid inlet, oriented in a direction opposite a direction of rotation of the impeller.

A further aspect of the present invention is to provide an apparatus for mixing gas and liquid, comprising a draft tube having a liquid inlet, a gas inlet, and a mixed liquid/gas outlet, at least one impeller rotatably mounted at least partially within the draft tube comprising at least one blade, and means for creating a reduced pressure zone which directs gas axially downward within the draft tube.

These and other aspects of the present invention will be more apparent from the following description.

DETAILED DESCRIPTION

The present invention relates to an apparatus for mixing gas and liquid. Specifically, the invention relates to a system and method for mixing gas into a liquid by accelerating a body of liquid utilizing a low pitch ratio impeller which generates relatively high angular velocity and relatively low axial velocity, introducing gas to the body of liquid, and shearing the gas into fine bubbles by rotating the impeller. As used herein, the term "angular velocity" means fluid velocity that follows a substantially circular path around the axis of rotation of an impeller. As used herein, the term "axial velocity" means fluid velocity that is substantially parallel to the shaft of the impeller. As used herein, the term "axial distance of the impeller" means the axial distance traced by following the pitch of an impeller blade through a 360 degree rotation about the axis of rotation. As used herein, the term "pitch ratio" means the ratio of the axial distance of the impeller to the diameter of the impeller. The pitch ratio of an impeller may also be defined as the axial distance that a column of fluid is advanced by a 360 degree rotation of the impeller, assuming 100% efficiency.

Figure 1:
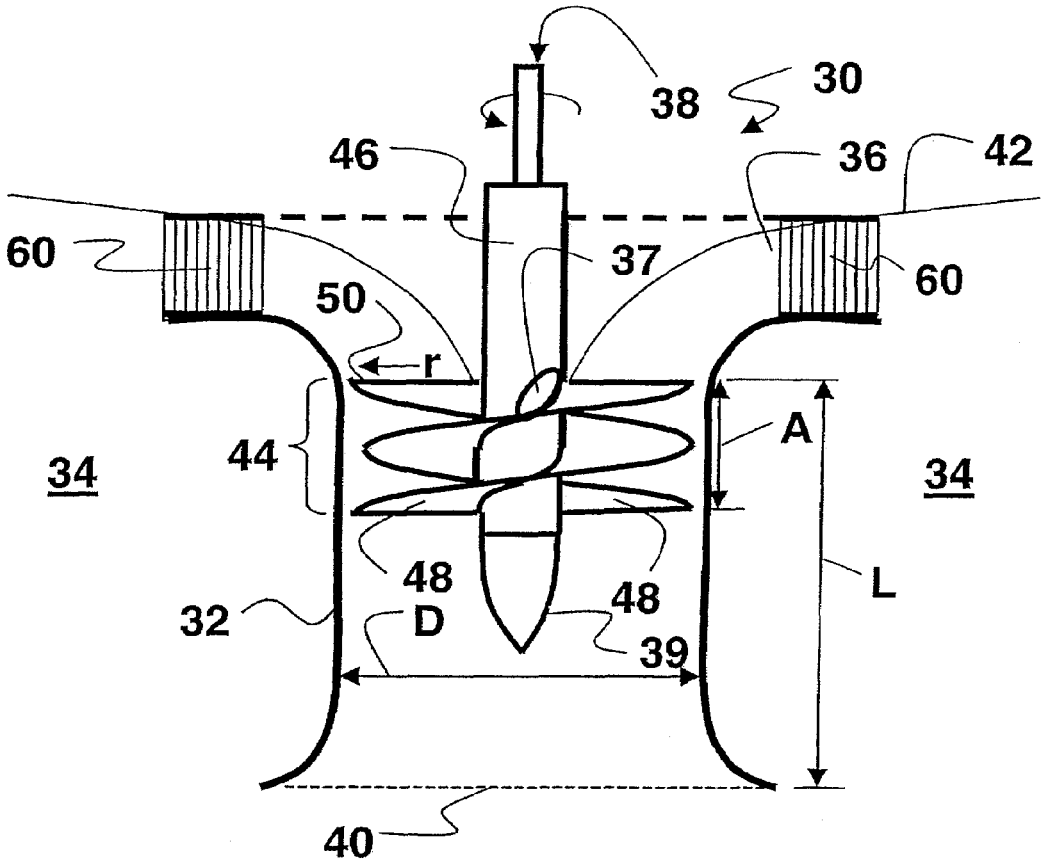
FIG. 1 is a partial cross-sectional side view of a gas-liquid mixing apparatus in accordance with an embodiment of the present invention.
Figure 2:
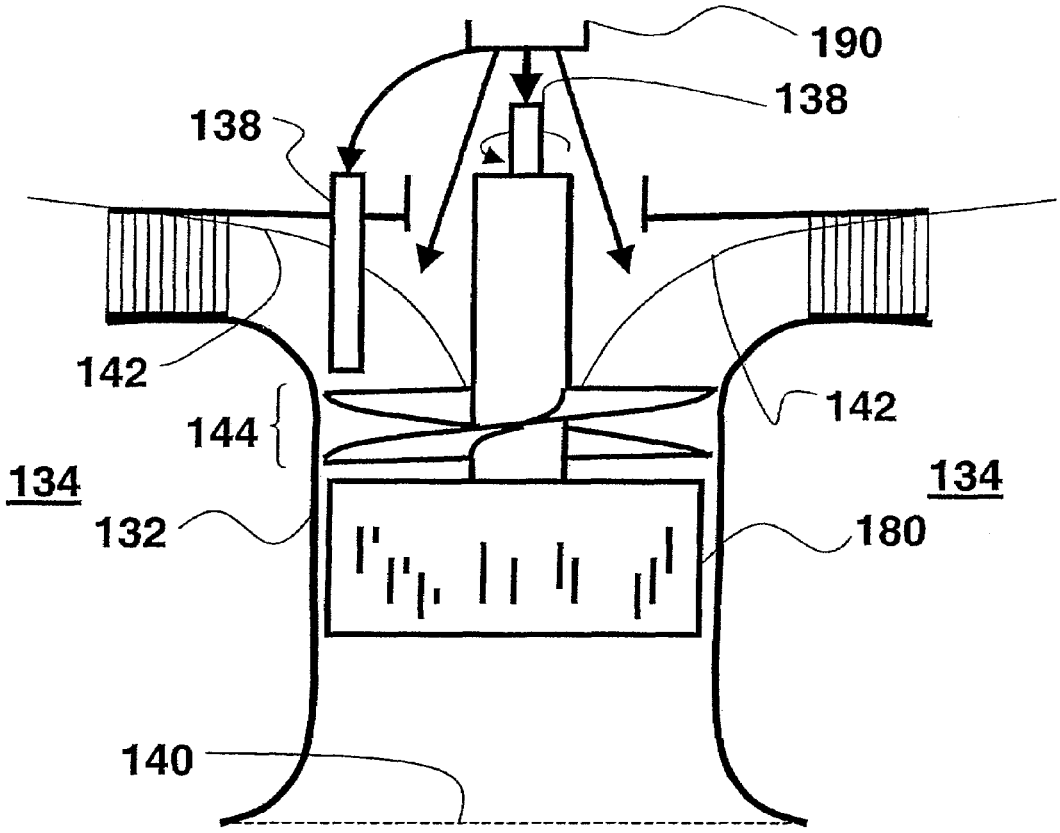
FIG. 2 is a partial cross-sectional side view of a gas-liquid mixing apparatus having a gas inlet positioned along the perimeter of the draft tube in accordance with an embodiment of the present invention.

As shown in FIG. 1, the mixer 30 comprises a draft tube 32 positioned within a body of liquid 34. The draft tube 32 has at least one liquid inlet 36 for introducing liquid into the draft tube 32. The liquid inlet 36 of the draft tube 32 can be positioned to extend into the body of liquid 34 to any desired depth, such as near the surface of the liquid 42, for example, from about 0.5 to about 2 feet below the surface of the liquid 42. In one example, the liquid inlet 36 extends about 1.3 feet into the body of liquid 34 within the draft tube 32. The liquid inlet 36 can have any suitable dimensions to allow sufficient liquid flow to enter the draft tube 32. The liquid inlet 36 can direct liquid containing little to no entrained gas from the body of liquid 34 into the draft tube 32. The draft tube 32 also comprises at least one gas inlet. The gas inlet may comprise an upper opening in the draft tube 32. In addition, a gas inlet 38 can be positioned near the center of the impeller 44, such as substantially concentric with or surrounding the shaft 46 of the impeller 44 as shown in FIG. 1. Alternatively, as shown in FIG. 2, the gas inlet 138 can be positioned adjacent the outer perimeter of the draft tube 132 which allows gas to be directed below the surface of the liquid 142 to the impeller 144. The gas inlet 38 delivers gas from an area outside the liquid contained in the draft tube 32 to an area adjacent an impeller 44 rotatably mounted within the draft tube 32 on a shaft 46 as shown in FIG. 1.

As shown in FIG. 1, at least one impeller 44 is rotatably mounted on a shaft 46. Shaft 46 is driven by any suitable driving mechanism, such as a motor and/or gearbox (not shown). In one embodiment, the rotational speed of the impeller is from about 150 rpm to about 350 rpm. In another embodiment, the rotational speed of the impeller is from about 200 rpm to about 225 rpm.

The impeller 44 comprises at least one blade assembly 48. The blade assembly 48 can comprise a single continuous blade or a plurality of blades. In one embodiment, the blade assembly 48 comprises at least one blade extending at least about 30° around the axis of rotation of the impeller 44. In another embodiment, the blade assembly 48 comprises at least one blade extending at least about 60° around the axis of rotation of the impeller 44. In another embodiment, the blade assembly 48 comprises at least one blade extending at least about 90° around the axis of rotation of the impeller 44. In yet another embodiment, the blade assembly 48 comprises at least one blade extending from at least about 180° to at least about 360° around the axis of rotation of the impeller 44. The blade assembly 48 can comprise any number of blades, such as 2 to 10 blades, such as 3 to 8 blades. In one embodiment, the number of individual blades in a blade assembly 48 is equal to the circumference of the impeller 44 divided by 2.5 feet. For example, an impeller 44 having a diameter of 6 feet would have:

$$(6\times3.14)/2.5=7.5 \text{ or } 7 \text{ to } 8 \text{ blades.} \qquad \text{Eq 1}$$

Figure 3:
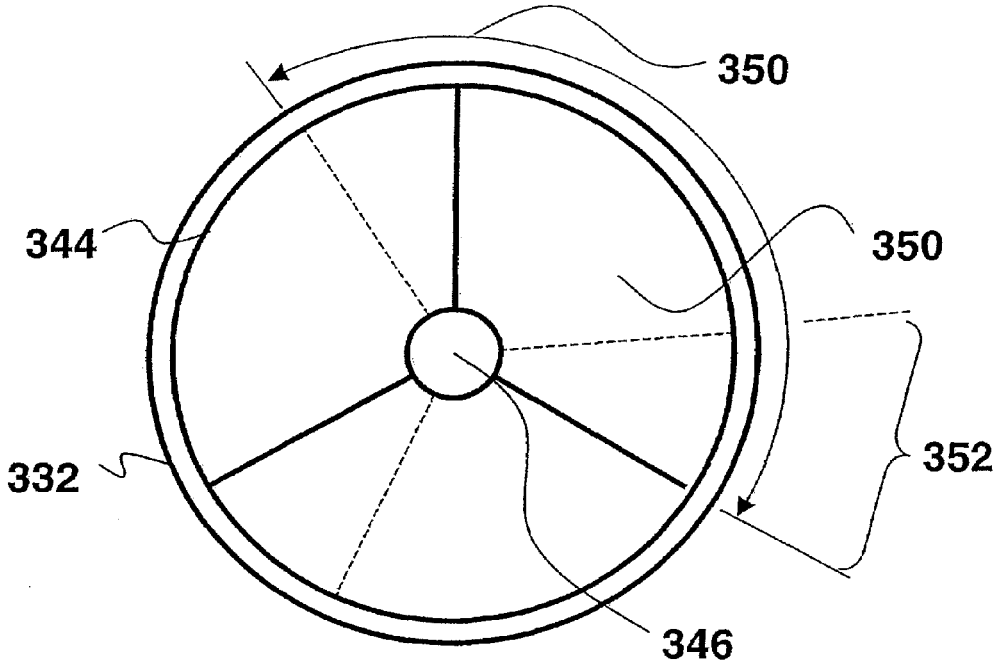
FIG. 3 is a top view of an impeller having three overlapping blades in accordance with an embodiment of the present invention.
Figure 4:
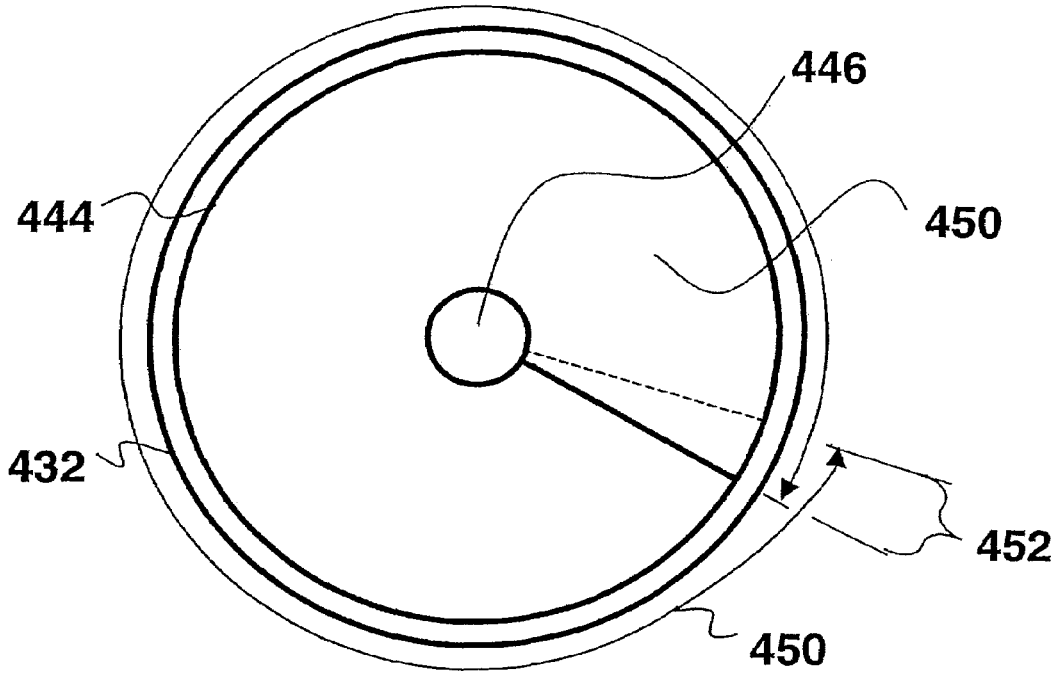
FIG. 4 is a top view of an impeller having a single overlapping blade in accordance with an embodiment of the present invention.

As shown in FIG. 3, the impeller 344 rotatably mounted within the draft tube 332 can comprise a plurality of overlapping individual blades 350 extending around the shaft 346 of the impeller. For example, the individual blades 350 can overlap each other by an overlap region 352 in a plane extending parallel to the axis of rotation of the impeller 344, i.e., as seen from the top down or the bottom up of the draft tube 332 by an overlap region 352. As shown in FIG. 4, the impeller 444 rotatably mounted within the draft tube 432 can comprise a single blade 450. In one embodiment, the impeller 444 can comprise a single blade 450 extending more than 360° around the shaft 446 of the impeller. The single blade 450 can have an overlap region 452 in a plane extending parallel to the axis of rotation of the impeller 444.

Figure 5:
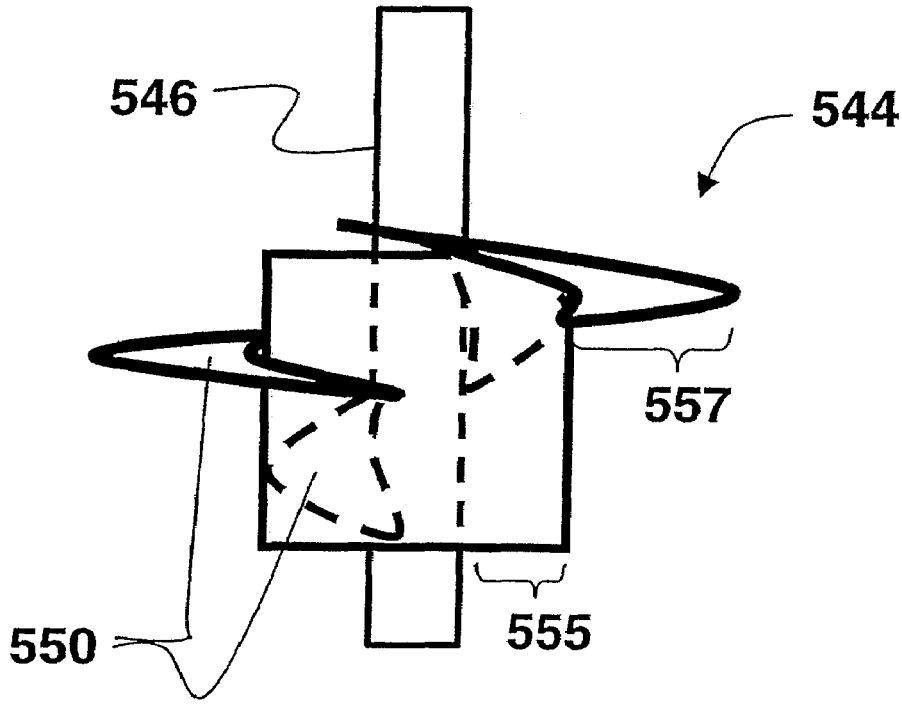
FIG. 5 is a partial view of an impeller blade having a first pitch ratio region and a second pitch ratio region in accordance with an embodiment of the present invention.

In accordance with an embodiment of the present invention, the impeller has a pitch ratio of less than 1:1. For example, the impeller 44 may have a pitch ratio of from about 0.05:1 to about 0.8:1. For example, the impeller 44 may have a pitch ratio of from about 0.2:1 to about 0.4:1. For example, the impeller 44 may have a pitch ratio of from about 0.1:1 to about 0.5:1. As shown in FIG. 5, the impeller 544 can comprise multiple pitch ratios. In one embodiment, the impeller 544 comprises a blade 550, mounted on the shaft 546, having a first region 555 having a first pitch ratio and a second region 557 having a second pitch ratio. The first pitch ratio can be from about 2 to about 5 times greater than the pitch ratio of the second region. In one embodiment, the first region has a pitch ratio of from about 1:1 to about 1:1.5 and the second region has a second pitch ratio of from about 0.2:1 to about 0.5:1.

Figure 6:
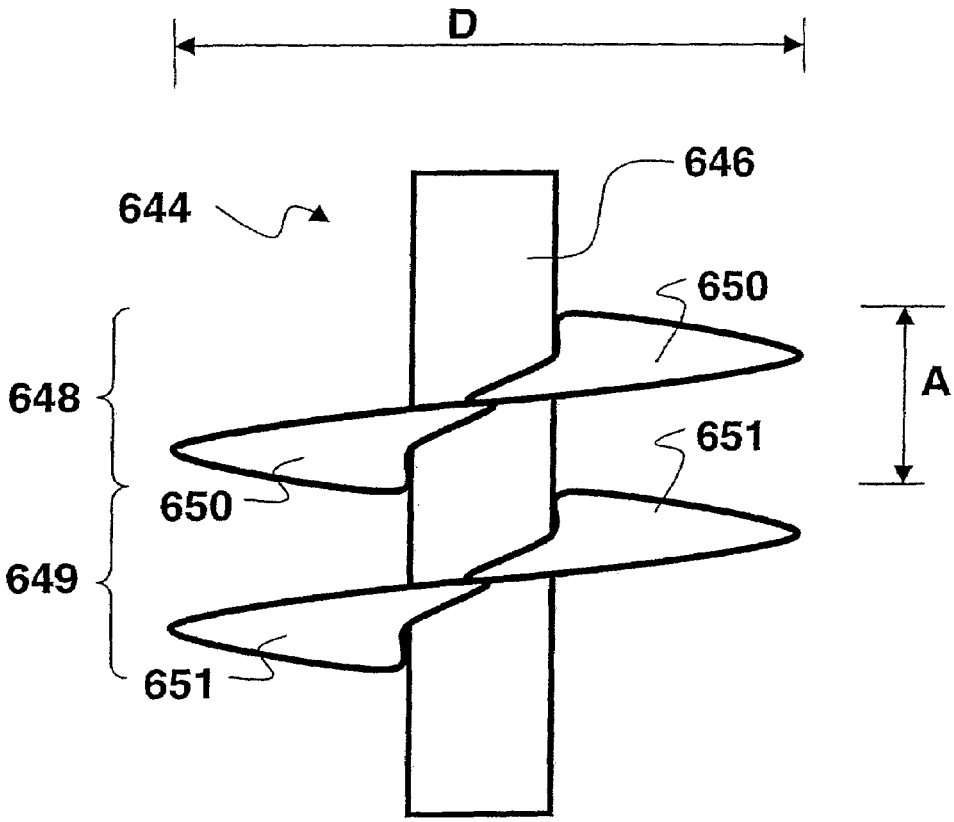
FIG. 6 is a side view of an impeller having a first blade assembly and a second blade assembly in accordance with an embodiment of the present invention.

In accordance with an embodiment of the present invention, as shown in FIG. 6, the impeller 644 can have a diameter D that is greater than the axial length of the impeller A. Axial length A is determined by tracing a blade through a rotation of 360°. In one embodiment, the diameter D of the impeller is at least 1.5 times larger than the axial length, such as at least 2.5 times larger. In this embodiment, the impeller 644 can comprise at least one blade assembly 648 comprising at least one blade 650 extending at least about 30° around the shaft 646 of the impeller 644. The impeller 644 can comprise at least one blade assembly 648 comprising at least one blade 650 extending at least about 60° around the shaft 646 of the impeller 644. For example, the impeller 644 can comprise at least one blade assembly 648 comprising at least one blade 650 extending at least 90° around the shaft 646 of the impeller 644.

Referring again to FIG. 1, as the impeller 44 is rotated within the draft tube 32, the low pitch ratio of the impeller causes the body of liquid within the draft tube 32 to rotate with relatively low angular velocity and relatively low axial velocity. For example, an impeller having a pitch ratio of 0.33:1 will rotate three times the number of rotations as an impeller having a pitch ratio of 1:1, assuming the same efficiency, in order to move the same volume of liquid in an axial direction. Low pitch ratio impellers therefore create high differential angular velocity relative to higher pitch ratio impellers. The differential velocity between the angular velocity of the blade assembly 48 and the velocity of the liquid in the plane normal to the impeller shaft 46 creates both drag and liquid-gas shear due to the differences in the speed of the liquid and the gas introduced to the liquid, and blade wake currents if gas is present in the accelerated liquid. As used herein, the term "blade wake currents" means a thin layer of liquid which is given angular acceleration by the friction between the rotating blade assembly 48 and the body of liquid within the draft tube 32. Gases directed to the impeller 44 through ports 37 in the gas inlet 38 are drawn across the top edge of the impeller blade and then into the body of liquid by the shearing action of liquid vortices. The large gas volume is accordingly sheared into small bubbles. The rotation of the impeller 44 creates a reduced pressure zone into which gas is drawn, creating shear between the differential velocities. These gases are then entrained into the body of liquid and move axially within the draft tube 32. As shown in FIG. 1, a stabilizing cone 39 can be included with the impeller 44 to effectively distribute the gas-liquid mixture away from the blades of the impeller.

Figure 7:
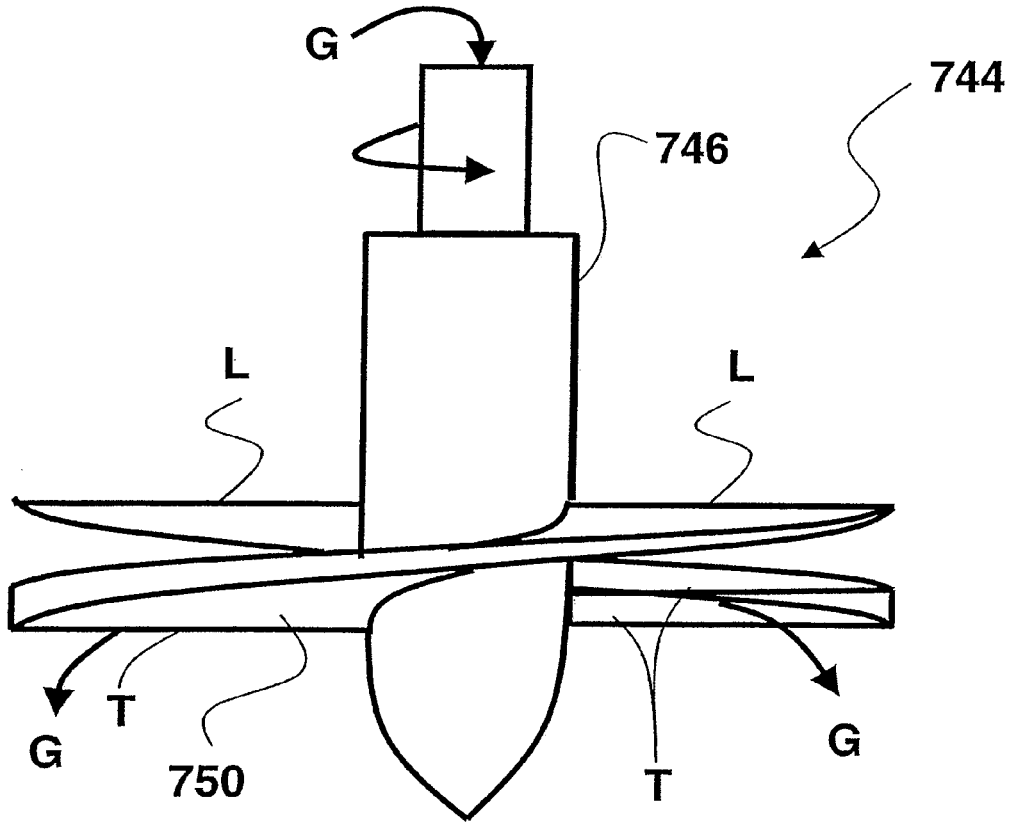
FIG. 7 is a side view of an impeller having a leading edge and a trailing edge shown in accordance with an embodiment of the present invention.

As the impeller 44 rotates, the rotating blade assembly 48 creates reduced pressure zones adjacent to the individual blades 50 that are designed to draw gas radially, as shown in FIG. 1 as arrow r, across the blade 50 and direct the gas to an area of reduced pressure, e.g., above and under the leading edge of blade 50. As blade 50 rotates gas is directed above and under the blade 50 where it is sheared into fine bubbles by eddy currents created by blade wake currents. The reduced pressure zones can be enhanced by the shape of each individual blade 50. The design of each blade 50 can control the amount of gas that can be entrained into the liquid per rotation. As shown in FIG. 7, each blade 750 has a leading edge L and a trailing edge T. As shown in FIG. 7, rotation of the impeller 744 about the shaft 746 causes a reduced pressure area to form just trailing the top leading edge L of the impeller blades 750 (for down-pumping impellers), allowing gas G from gas inlet 738 to be drawn radially across the blade 750 in a direction that is perpendicular to the plane of the blade 750 to the reduced pressure zone. As the blade 750 is rotated through the liquid on a plane normal to the axial flow of the liquid, the gas G is drawn into the liquid by vortices caused by blade wake currents.

Figure 8A:
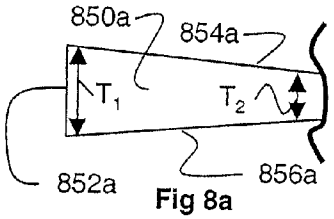
FIGS. 8*a*-8*c* are side views of a blade having an area of increased thickness at the perimeter edge in accordance with an embodiment of the present invention.
Figure 8B:
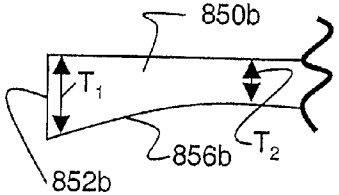
Figure 8C:
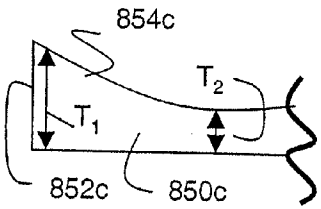

As shown in FIGS. 8*a*-8*k*, the blade 850 can be constructed in various configurations to enhance the reduced pressure zone. As shown in FIG. 8*a*, the thickness of the blade 850*a* can vary, creating an area of increased thickness $T_1$ at the trailing edge 852*a* of the blade 850*a* as compared to the thickness $T_2$ at the leading edge of the blade 850*a*. As shown in FIG. 8*a*, both the top surface 854*a* and the bottom surface 856*a* of the blade can be tapered to achieve the increase in thickness at the trailing edge 852*a*. As shown in FIG. 8*b*, only the bottom surface 856*b* is tapered to achieve the increase in thickness at the trailing edge 852*b*. As shown in FIG. 8*c*, only the top surface 854*c* is tapered to achieve the increase in thickness at the trailing edge 852*c*.

Figure 8D:
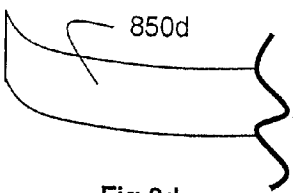
FIGS. 8*d* and 8*e* are side views of a blade having a curved orientation in accordance with an embodiment of the present invention.
Figure 8E:
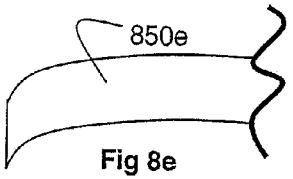
Figure 8F:
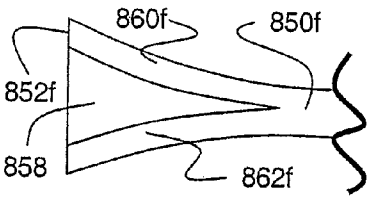
FIGS. 8*f*-8*h* are side views of a blade having a hollow cavity formed within the blade in accordance with an embodiment of the present invention.
Figure 8G:
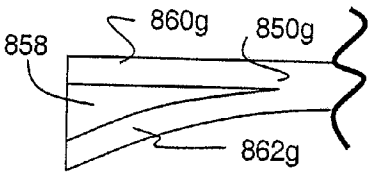
Figure 8H:
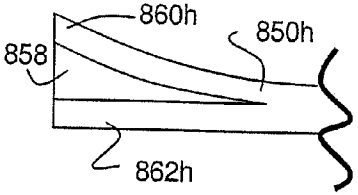

As shown in FIG. 8*d*, the blade 850*d* can have an upwardly curved shape at its trailing edge. As shown in FIG. 8*e*, the blade 850*e* can have a downwardly curved shape at its trailing edge. As shown in FIG. 8*f*, a hollow cavity 858 can be formed at the trailing edge 852*f* of the blade 850*f*. Alternatively, the hollow cavity 858 can be formed at the leading edge of the blade 850*f*. The hollow cavity 858 can be formed by shaping or carving out a section from a solid blade or can be formed by fixing a first end of a first blade piece 860*f* and a first end of a second blade piece 862*f* and leaving a second end of the first blade piece 860*f* and a second end of the second blade piece 862*f* unattached. As shown in FIG. 8*f*, both the first blade piece 860*f* and the second blade piece 862*f* of the blade 850*f* can be tapered. As shown in FIG. 8*g*, only the second blade piece 862*g* is tapered. As shown in FIG. 8*h*, only the first blade piece 860*h* is tapered.

Figure 8I:
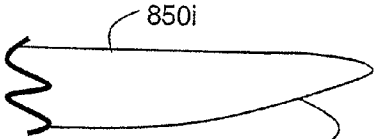
FIGS. 8*i*-8*k* are side views of a blade having a slanted perimeter edge and/or a protrusion in accordance with an embodiment of the present invention.
Figure 8J:
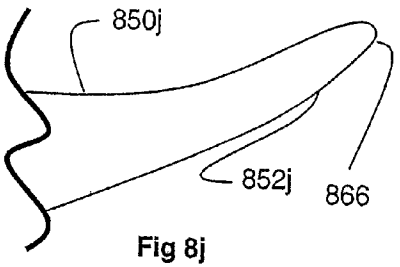
Figure 8K:
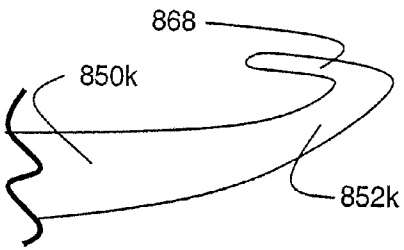

As shown in FIG. 8*i*, the blade 850*i* can be rounded and slanted at the leading edge 852*i*. As shown in FIG. 8*j*, the blade 850*j* can have a protrusion 866 at the leading edge 852*j*. As shown in FIG. 8*k*, the blade 850*k* can have a curved protrusion 868 at the leading edge 852*k*.

Figure 9:
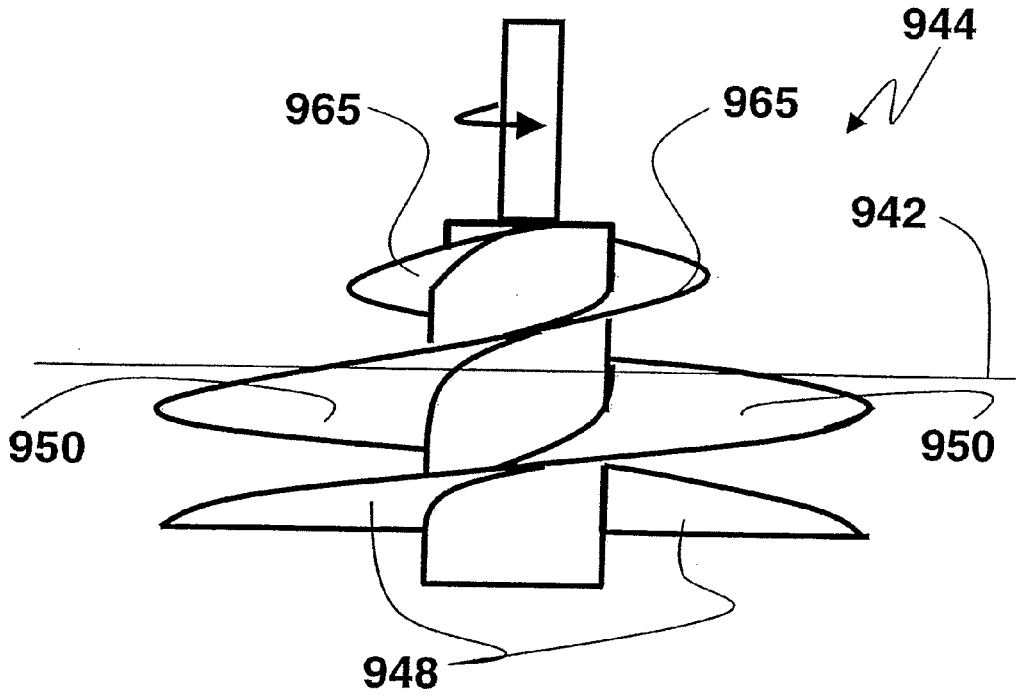
FIG. 9 is a side view of an impeller having flights extending above the surface of a liquid in accordance with an embodiment of the present invention.

In another embodiment as shown in FIG. 9, the blade assembly 948 of the impeller 944 can comprise blades 950 having flights 965 which extend at least partially above the surface of the liquid 942. As the blades 950 rotate, cavities are formed along the leading edges of the blades 950 which channel gas to a point below the surface of the liquid. This is due to the reduced pressure zones created directly behind the cavities formed under the liquid on the top surface of the blades. Gas introduced radially along the blades 950 is directed into the liquid in a spiraling direction and incorporated into the liquid within the draft tube.

Referring again to FIG. 1, the blades of the impeller 44 of the present invention are also designed to create zones of high sheer that distribute gas into the liquid within the draft tube 32 in the form of fine bubbles. In operation, as the impeller 44 is swiftly rotated through the liquid, a partial vacuum can be formed on the surface of the blades 50. The areas where cavitation would normally occur can be ventilated with gas. The gas is subsequently acted upon by the shearing forces of the liquid-blade interaction. Due to the shearing of the bulk gas into fine bubbles and blades 50 having relatively large surface area, entrained gas can be prevented by venting the low-pressure zone with a non-condensable gas.

In operation, gas bubbles formed by the rotation of the impeller will tend to rise toward the surface of the liquid. As shown in FIGS. 3, 4 and 6, the blades of the impeller can be constructed to substantially prevent gas bubbles from rising to the surface of the liquid within the draft tube. In order to prevent gas bubbles from returning to the surface of the liquid after being incorporated into liquid by the rotating impeller, the blades can be constructed such that at least a portion of one blade overlaps another blade. In this configuration, any gas bubbles that escape a first blade and travel toward the surface of the liquid become trapped by the second blade and incorporated into the liquid contents of the draft tube. As shown in FIG. 6, the impeller 644 can comprise a first blade assembly 648 mounted along the shaft 646 and a second blade assembly 649 mounted along the shaft 646 at an axial position below the first blade assembly 648. The first blade assembly 648 can comprise a single blade or a plurality of first blades 650 and the second blade assembly 649 can comprise a single blade or a plurality of second blades 651.

The required axial velocity the impeller must supply to the liquid is dependent on the submergence length L of the draft tube. Longer draft tubes require higher velocities for a given gas:liquid ratio to overcome the natural buoyancy of the gas bubbles for the specified time they are contained in the draft tube. As shown in FIG. 1, a draft tube 32 is measured from the inlet of the impeller 44 to the mixed gas-liquid outlet 40 of the draft tube 32. For example, a 16 foot long draft tube with an initial velocity of the mixed gas-liquid mixture leaving the impeller at 4 ft/second, having bubbles with a rise rate of 0.5 ft/second in stagnant water, will contain bubbles of gas within the draft tube for more than 4 seconds. The bubbles of gas can impede the downward liquid flow by about 2 ft/sec over the 4 second period. This in turn creates higher pressures for the impeller to pump against, increasing either power consumption or reducing the pumped liquid volume.

For gas-liquid mixing systems that aerate a liquid, certain draft tube configurations are preferred. Air typically contains about 23% by weight oxygen. Therefore, for a given power input, it is preferable to circulate higher volumes of liquid and high concentration air at low backpressures with relatively low axial velocities, on the order of from 0.6 to 2.1 m/sec, in a shorter draft tube having a length L of 1.3 meter to about 3 meters, than to circulate smaller volumes of liquid and air at higher backpressures in a longer draft tube, having a length L of about 5 meters. In both of these configurations, power consumption is similar, however, the efficiency of oxygen transfer in longer draft tubes drops due to the higher power consumption due to higher required pressures axial velocities.

Figure 10:
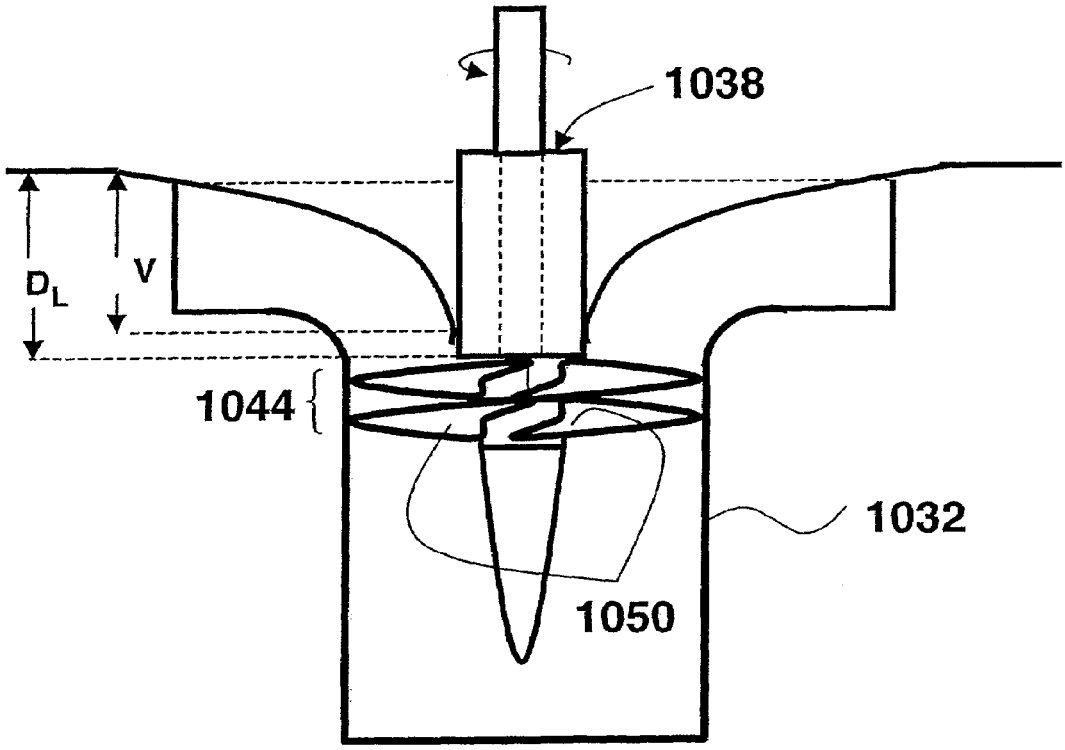
FIG. 10 is a partial cross-sectional side view of a gas-liquid mixing apparatus illustrating vortex formation in accordance with an embodiment of the present invention.

In order to reduce the energy required to entrain gas within the liquid several techniques can be utilized. When an impeller is placed near the surface of a body of liquid in a generally vertical orientation, and the impeller blades are angled to force the liquid in a downwards direction during rotation, the rotation of the blades causes the liquid profile at the center of the rotating blades to be depressed. This vortex, or decreased depth of liquid, allows for gas to be introduced into a body of liquid at a greater depth with less pressure. For example, as shown in FIG. 10, in order for gas to be aspirated into a liquid to a specified depth $D_L$ without the use of a vortex or low-pressure zone, the gas must be pressurized to a pressure equal to or greater than the static head of the liquid at depth $D_L$. However, when a vortex is present, the depth of the vortex V can be subtracted from the liquid depth $D_L$ when determining the pressure needed to introduce gas to the desired depth. The amount of pressure head needed to introduce gas to a liquid profile depth $D_L$ is $D_L-V$. When the gas inlet 1038 directs gas to the reduced pressure zones formed by rotating the blades 1050 of the impeller 1044 within the draft tube 1032, is at or below depth V, the gas does not require any pressure to become entrained within the liquid, i.e., no additional force is necessary to drive the gas into the liquid until is reaches the depth $D_L-V$. The depth of the vortex depends on the direction and velocity of the liquid.

One method of reducing the energy required to entrain gas within the liquid includes utilizing an impeller having a multiple pitch ratios. If a multiple pitch ratio impeller having a higher pitch ratio toward the center or hub of the impeller is used, such as the blade configuration shown in FIG. 5, then during rotation the axial velocity of the liquid is greater than the axial velocity of the liquid toward the perimeter of the draft tube. Gas can be added to the blades of the impeller without requiring that the total liquid stream be accelerated to the velocity necessary to overcome the liquid head. By accelerating only a small portion of the liquid in the draft tube to a velocity required to draw gas down from the liquid surface. The rotation of the impeller blades through the liquid creates a reduced pressure zone at about the center of the impeller that is communicated across or through the blades to either the center or the perimeter of the blade. If the blades are angled to force the liquid in a downwards direction, the reduced pressure zone will be located either on the top of the leading edge or in communication with a reduced pressure zone created aft of an area of the blade having increased thickness. Likewise, if the blades are angled to force the liquid in an upwards direction, the reduced pressure zone will be located in communication with the leading edge of the blade. Accordingly, provided the impeller blades are aligned properly, the gas-liquid mixer of the present invention can pump liquid in any direction as it incorporates and shears gas into the liquid.

Another method of increasing the axial velocity of the liquid within the draft tube, thereby increasing the liquid depression of the vortex, is to counter-rotate the liquid entering the draft tube in a direction that is opposite the direction of rotation of the impeller. The impeller turns in a first direction, which can be either clockwise or counter-clockwise. As shown in FIG. 1, for a down pumping unit, a series of liquid turning vanes 60 can be positioned at an area adjacent the liquid inlet 36 of the draft tube 32. These liquid turning vanes 60 are positioned substantially external to the draft tube 32, however, it should be understood that a small portion of the liquid turning vanes 60 may extend minimally into an inside diameter of the draft tube 32. The liquid inlet turning vanes rotate the liquid that is directed to the inlet 36 of the draft tube 32 in a direction that is opposite the direction of rotation of the impeller 44. This counter-rotation of the inlet liquid by the liquid turning vanes 60 counteracts the rotational forces applied to the liquid by the impeller 44.

Figure 11:
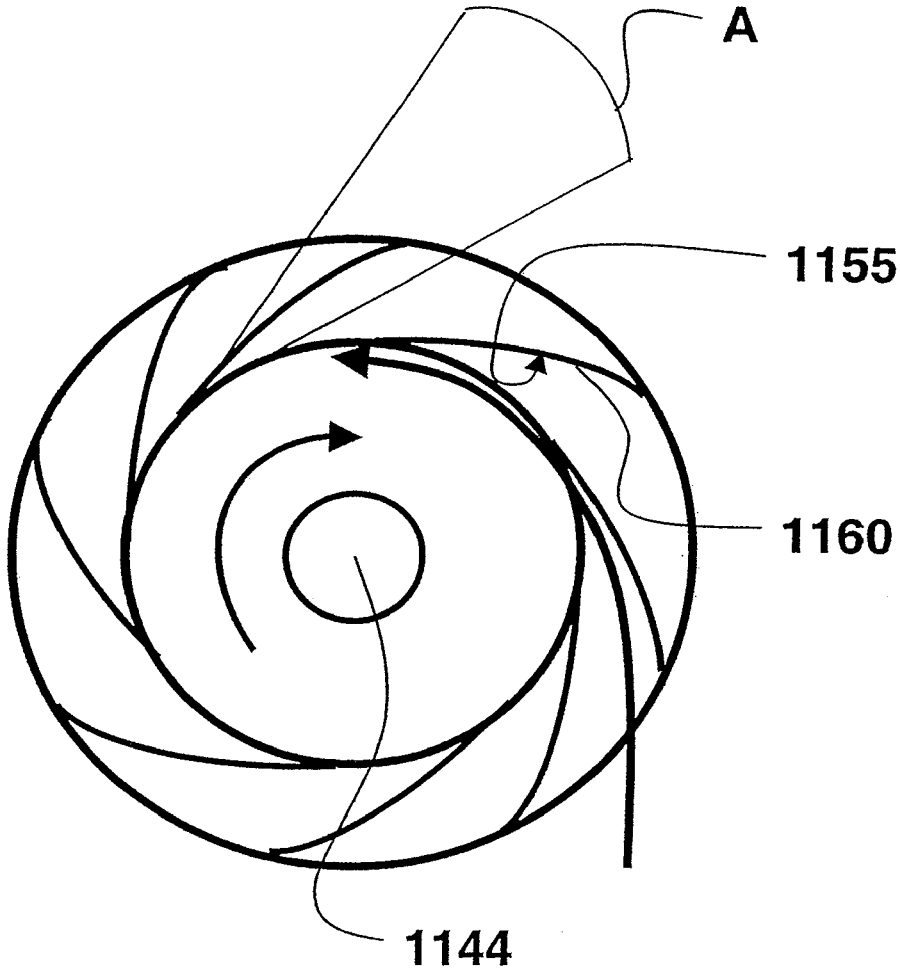
FIG. 11 is a top view of liquid turning vanes in accordance with an embodiment of the present invention.
Figure 12:
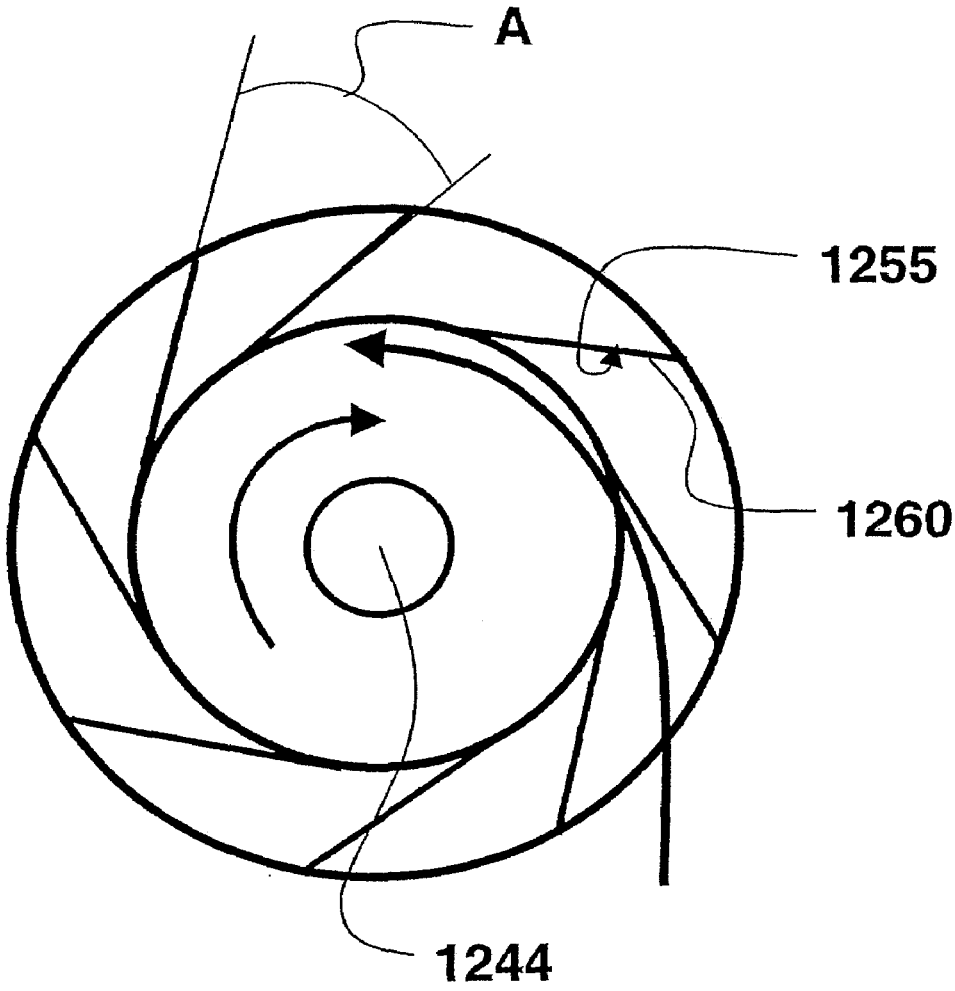
FIG. 12 is a top view of liquid turning vanes in accordance with an embodiment of the present invention.
Figure 13:
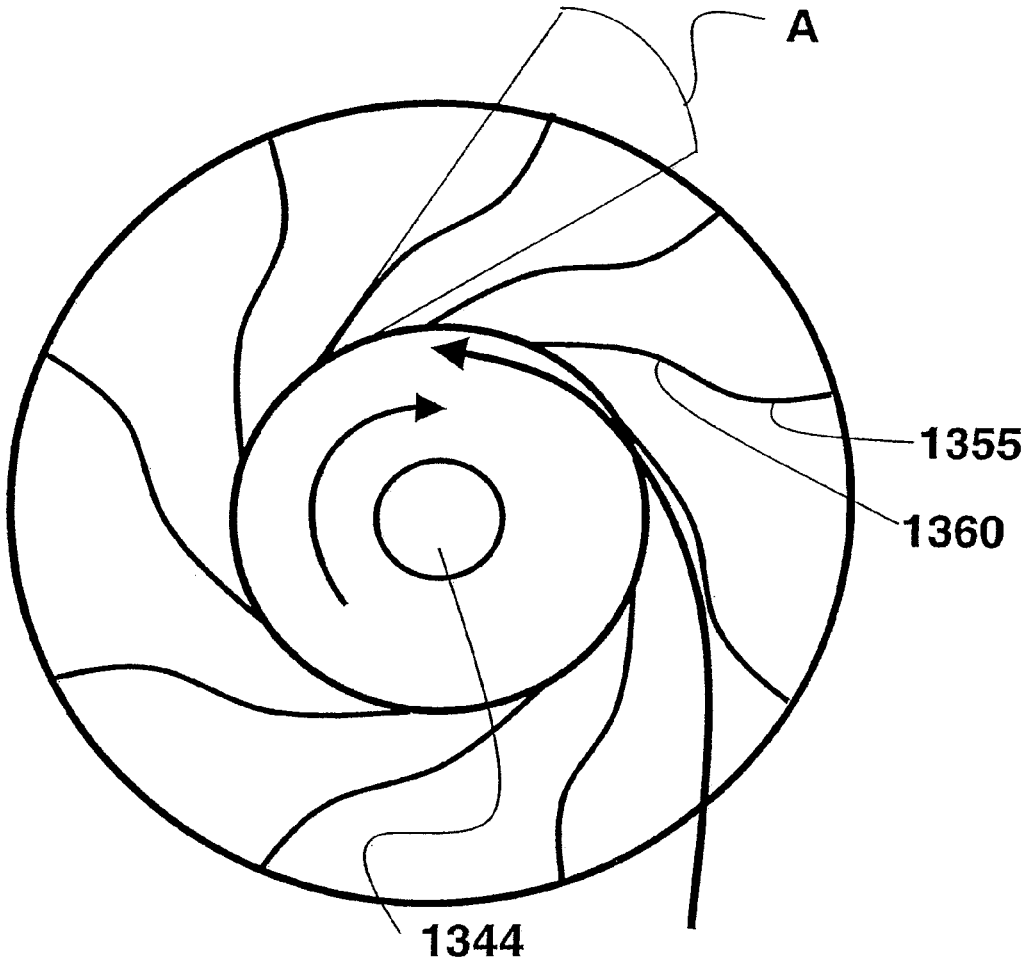
FIG. 13 is a top view of liquid turning vanes in accordance with an embodiment of the present invention.

As shown in FIGS. 11-13 a plurality of liquid turning vanes can be used in accordance with an embodiment of the present invention. Each liquid turning vane comprises a fluid directing surface that contacts the incoming liquid. The fluid directing surface can be straight, convex or concave. As shown in FIG. 11, liquid turning vanes 1160 having a fluid directing surface 1155 are oriented to rotate the incoming liquid in a direction that is opposite the direction of the impeller 1144. As shown in FIG. 11, the fluid directing surface is concave. A plurality of liquid turning vanes can be positioned adjacent the liquid inlet. In one example, the liquid turning vanes 1160 can be circularly disposed about the draft tube at a diameter of from 1.2 to 1.4 times the diameter of the draft tube. The number of liquid turning vanes 1160 can be from about 1 to about 4 liquid turning vanes per every foot of diameter of the draft tube. The liquid turning vanes are oriented to deliver liquid essentially tangentially to the liquid inlet of the draft tube. The liquid turning vanes 1160 are positioned to form an angle A as measured by the intersection of the edge of the liquid turning vane 1160 and the tangent of the liquid inlet perimeter. The liquid turning vanes 1160 can have an angle A of from 0° to about 90°, such as from about 5° to about 45°. As shown in FIG. 12, the liquid turning vanes 1260 are oriented to rotate the incoming liquid in a direction that is opposite the direction of the impeller 1244 and have a fluid directing surface 1255 that is straight. As shown in FIG. 13, the liquid turning vanes 1360 are oriented to rotate the incoming liquid in a direction that is opposite the direction of the impeller 1344 and have a fluid directing surface 1355 that is convex.

Counter rotating the liquid entering the draft tube has several benefits. First, it establishes a vortex flow where the counter rotating angular velocity near the center or hub of the impeller is much higher than at its perimeter. This increases the axial velocity at the center of a constant pitch ratio impeller as compared to the axial velocity at the perimeter, thereby increasing gas incorporation. Second, it creates a much higher angular velocity at the center of the impeller. This causes the liquid level inside the vortex to draw down well below the liquid level outside the impeller. This allows gas to communicate directly with the reduced pressure zones formed by rotating the impeller blades. Third, the counter rotated liquid velocity is additive to the angular velocity of the impeller, increasing axial pumping rates for a given rotational speed. Lower impeller speeds can produce higher axial flow rates, reducing mechanical wear. Fourth, it reduces mechanical stress on the impeller. By moving the liquid turning vanes away from a position immediately adjacent the impeller, shock waves that are propagated each time a rotating blade comes into close proximity with a stationary blade are minimized, thereby reducing mechanical shocks to the mixing system. Liquid turning vanes that are positioned immediately adjacent to an impeller receive shock waves each time the impeller blades pass near a liquid turning vane. Metal fatigue and stress cracking are typical for systems employing liquid turning vanes immediately adjacent an impeller. Fifth, liquid leaving the impeller is directed in a substantially axial direction with little to no angular velocity component.

Figure 14:
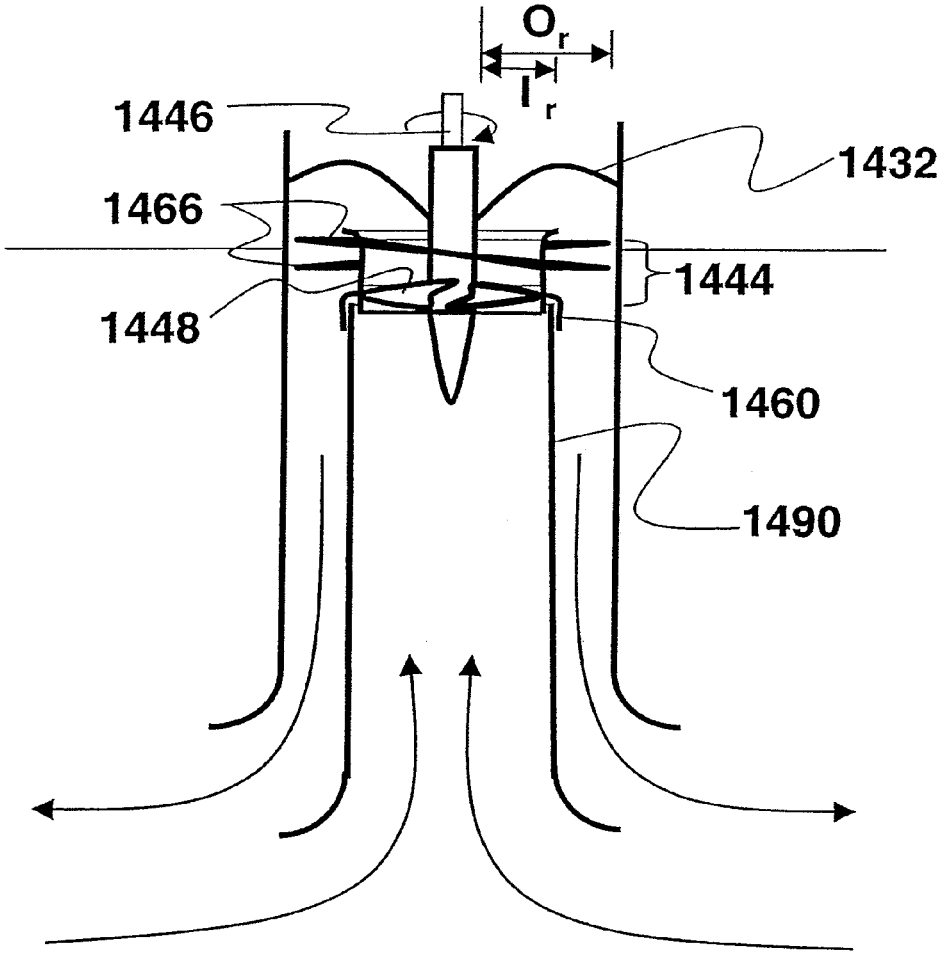
FIG. 14 is a partial cross-sectional side view of a gas-liquid mixing apparatus having a circular impeller cuff and a second blade assembly mounted on the impeller cuff in accordance with an embodiment of the present invention.
Figure 15:
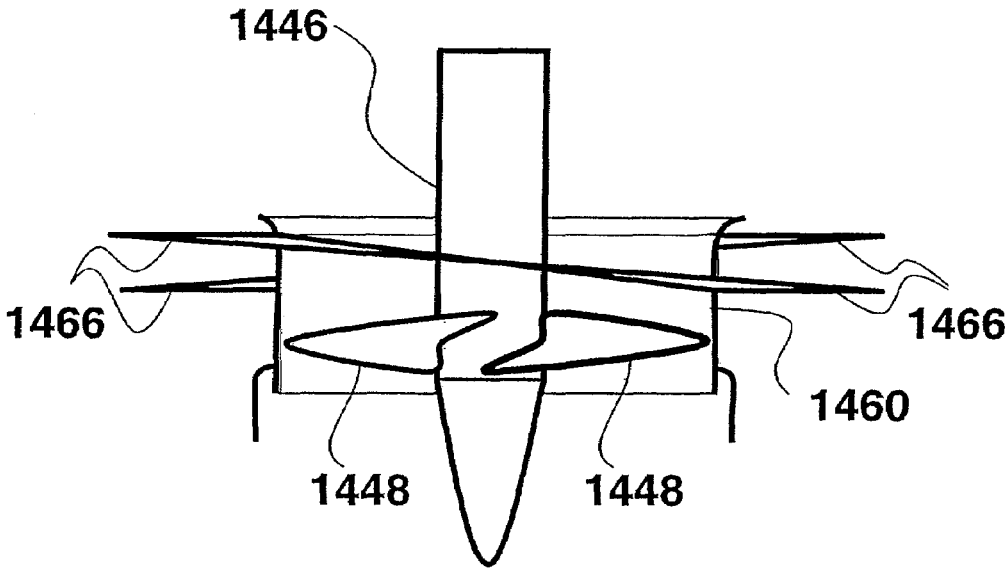
FIG. 15 is a side view of the impeller of the gas-liquid mixing apparatus of FIG. 14 in accordance with an embodiment of the present invention.

Another method of reducing the energy required to entrain gas within the liquid is to include two sets of impeller blades rotating in the same direction. As shown in FIGS. 14-15, a draft tube 1432 comprises an impeller 1444 comprising at least one first blade assembly 1448 mounted along the shaft 1446 angled in a first direction of rotation and having an inner first blade radius $I_r$ measured from the shaft 1446 to the tip of the first blade assembly 1448 as shown. The impeller 1444 also comprises a circular impeller cuff 1460 rotatably mounted on the shaft 1446. In one embodiment, the impeller cuff 1460 is fixed to the tips of the first blade assembly 1448 as shown. The impeller 1444 also comprises at least one second blade assembly 1466 angled in a second direction that is opposite the first direction of the first blade assembly 1448, mounted along the circular impeller cuff 1460 in substantially the same plane or above as the first blade assembly 1448 if the liquid is being pumped up from the center through the first blade assembly 1448 and cresting over cuff 1460 and subsequently down through the second blade assembly 1466. The first blade assembly 1448 can have a pitch that is higher than the pitch of the second blade assembly. The ratio of the pitch of first blade assembly 1448 to the pitch of the second blade assembly 1466 can be greater than 1:1, although either the first blade assembly 1448 and/or the second blade assembly 1466 can have a pitch ratio of less than 1:1. The second blade assembly 1466 has a radius $O_r$ measured from the shaft 1446 to the tip of the second blade assembly 1466 as shown. The radial length of the second blade assembly 1466 will be substantially $O_r$–$I_r$, where radius $O_r$ is larger than radius $I_r$. Upon rotation, liquid in the draft tube 1432 between the impeller cuff 1460 and the draft tube 1432 is directed in a first axial direction and liquid in the draft tube located within the impeller cuff 1460 is directed in a second direction that is opposite the first direction. The impeller cuff 1460 may rotate within an inner stationary draft tube 1490.

The first blade assembly 1448 can be rotated to pump liquid up the inner stationary draft tube 1490. The first blade assembly 1448 can be positioned from about 1 to about 2 feet below the liquid surface and the second blade assembly 1466 can be positioned at, above or below the liquid surface. The impeller cuff 1460 can extend substantially to the surface of the liquid and can be rounded so as not to impede liquid passing over its edges. In operation, liquid pumped in an upward direction rises above the impeller cuff 1460 and subsequently flows over the second blade assembly 1466. In one embodiment, the draft tube 1432 can extend from any suitable distance above the liquid surface, such as from about 2 to about 3 feet above the liquid surface, such that liquid pumped up the inner stationary draft tube 1490 is confined within the draft tube 1432. Gas can be delivered to the second blade assembly 1466 from under the impeller cuff 1460 or by direct contact with ambient gas by the tips of the second blade assembly 1466. The second blade assembly 1466 can be angled to enhance gas-liquid mixing in deep tanks, such as those having a depth of at least 17 feet.

In one embodiment, liquid to be mixed with gas is drawn from near the bottom of the system and pumped upwards through the inner stationary draft tube 1490 through axial inlet counter rotation turning vanes that can be located adjacent the inlet of the impeller 1444. The liquid can be pumped by an impeller 1444 having a lower blade area ratio, over the impeller cuff 1460 where any rotation is turned by vanes to the opposite direction. Liquid can subsequently flow downwards and becomes mixed with gas as the second blade assembly 1466 force the liquid in the downwards direction. The draft tube 1432 may extend to a depth of from 5 to 16 feet above the bottom of the body of liquid within a tank. Fine bubbles leaving the draft tube 1432 are entrained in the liquid that is being drawn to the inlet of the inner stationary draft tube 1490, while the larger bubbles disengage from the pumped liquid and rise to the surface, creating their own secondary liquid circulation path.

Figure 16:
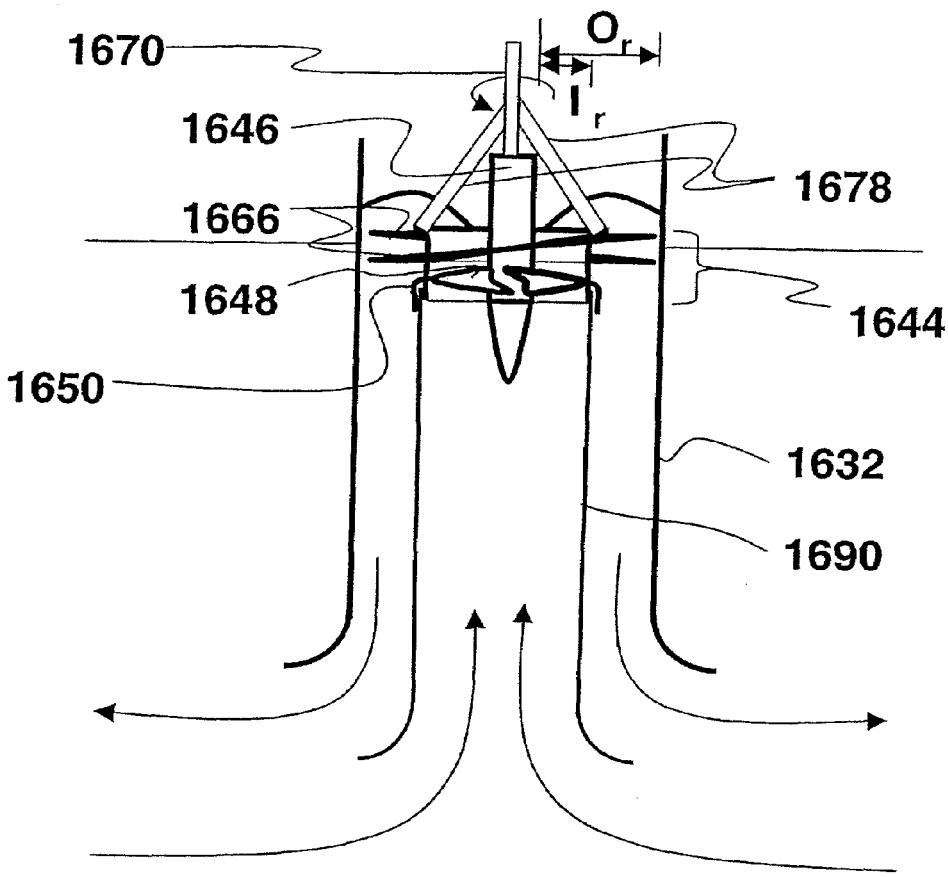
FIG. 16 is a partial cross-sectional side view of a gas-liquid mixing apparatus having two rotational shafts and two blade assemblies in accordance with an embodiment of the present invention.

In another embodiment, as shown in FIG. 16, the draft tube 1632 comprises an impeller 1644 mounted on a first shaft 1646 rotatable in a first direction and at least one first blade assembly 1648 mounted on the first shaft 1646. The first blade assembly 1648 is oriented in a first direction and has a radius $I_r$ measured from the shaft 1646 to the tip of the first blade assembly 1648 as shown. The impeller 1644 also comprises a second shaft 1670 circumferentially disposed about the first shaft 1646 that is rotatable in a second direction opposite the first direction. The second blade assembly 1666 is mounted on the second shaft 1670 and oriented in the same first direction as the first blade assembly 1648. The second blade assembly 1666 has a radius $O_r$ measured from the shaft 1664 to the tip of the second blade assembly as shown that is greater than the radius $I_r$ of the first blade assembly 1648. Upon rotation, liquid in the draft tube 1632 at about the center of the impeller is directed in a first direction and liquid in the draft tube located between the draft tube 1632 and the second shaft 1670 is directed in a second direction that is opposite the first direction.

The second blade assembly 1666 can be attached to the second shaft 1670 by any suitable means such as a plurality of spokes 1678, which are attached to the shaft and to an impeller cuff 1650 on which the second blade assembly 1666 is mounted. The spokes 1678 can have hydrofoil sections designed to engage ambient gas and aide deliver the gas along a reduced pressure zone into the pumped fluid as well as pump the gas-liquid mixture. The plurality of spokes 1678 can be driven from a co-axial drive hub located in the center of the second shaft 1670. In one embodiment, the hub can be located from about 1 to about 4 feet above the liquid surface. The spokes 1678 can extend radially out and downward, forming a conical shape and connecting to the perimeter of the impeller cuff 1650.

An inner draft tube 1690 can be attached to the second shaft 1670 and/or the impeller cuff 1650. The inner draft tube 1690 can extend below the draft tube 1632. Liquid can be pumped above the liquid level and then is directed downwards passing between concentric tubes 1670 and 1632 and then into the annular space created between the inner draft tube 1690 and the draft tube 1632.

Figure 17:
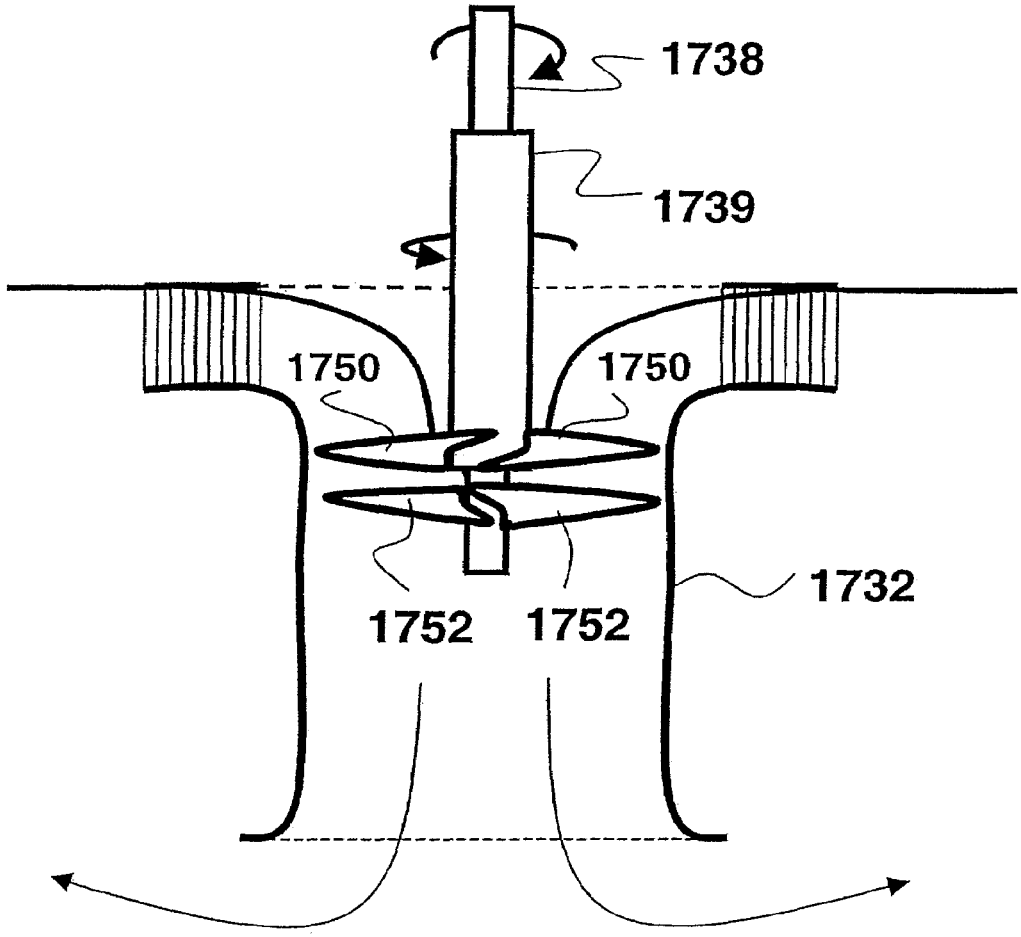
FIG. 17 is a partial cross-sectional side view of a gas-liquid mixing apparatus in accordance with an embodiment of the present invention.

In another embodiment as shown in FIG. 17, a first shaft 1739 rotates in a first direction and a second shaft 1738 rotates in the opposite direction. A first blade assembly 1750 is mounted to the first shaft 1739 and a second blade assembly 1752 is mounted on the second shaft 1738. The first shaft 1739 is concentric with the second shaft 1738. In one embodiment, the first shaft extends from an area connected to drive means, such as above the liquid surface, to the bottom of the first blade assembly 1750. The second shaft 1738 can extend from an area connected to drive means, such as above the liquid surface, vertically beyond the first shaft 1739 to the bottom of the second blade assembly 1752. The first blade assembly 1750 and the second blade assembly 1752 are not connected but rotate around co-axial shafts. The first blade assembly 1750 and the second blade assembly 1752 are angled in the same direction, however, the second blade assembly 1752 can have a pitch ratio that is about 10% greater than the pitch ratio of the first blade assembly 1750. The first blade assembly 1750 and/or the second blade assembly 1752 can have a pitch ratio that is less than 1:1. In this embodiment, the oppositely rotating shafts can reduce the angular acceleration of liquid exiting the draft tube 1732.

Referring again to FIG. 1, one gas and liquid have been mixed within the draft tube 32, the mixed gas-liquid mixture is directed out of the draft tube though a mixed gas-liquid outlet 40 and dispersed into the body of liquid 34. Sufficient fluid velocity must be present in the system in order to carry a bubble of gas to the desired liquid depth without allowing coalescing and stagnation of bubbles due to their natural tendency to rise in liquid in the vertical direction. In one embodiment, the system of the present invention has a Standard Aeration Efficiency (SAE) of greater than about 2.14 kg/kWh. In another embodiment, the system has an SAE of from about 3 to about 3.6 kg/kWh.

In one embodiment, as shown in FIG. 2, the mixed gas-liquid mixture exiting the mixed gas-liquid outlet 140 can through a series of straightening vanes 180 adjacent the mixed gas-liquid outlet 140. The straightening vanes 180 reduce the angular velocity of the gas-liquid mixture, thereby causing the gas-liquid mixture to be drawn down the draft tube 132 in the vertical direction. Once directed out of the mixed gas-liquid outlet, gas is further distributed into the body of non-aerated liquid 134.

In order to obtain the greatest driving force to dissolve the gas in the liquid, the feed to the impeller can be taken from an area of the body of liquid having the lowest concentration of gas in solution or as bubbles entrained in liquid. Conduits or open channels can be used to collect liquid having low gas concentrations from remote areas. This limits the formation of pockets of extensively aerated liquid and pockets of liquid that comprise almost no gas in solution or as bubbles within the body of liquid. By introducing substantially bubble free liquid through the liquid inlet, this ensures that a greater volume of gas is distributed throughout the liquid. Typically, gas bubbles will break the surface of the liquid in a circular area extending from about 2 to about 10 times the diameter of the impeller, with the center of the circular area being the shaft of the impeller.

It is contemplated herein that the apparatus and method for mixing gas and liquid as described herein could be used in conjunction with a direct contact heat exchanger. In this embodiment, the combustion products from either a hot gas or a flame source 190 can be either located in or conveyed to the gas inlet 138, as shown in FIG. 2, and introduced into the liquid contained in the draft tube 132. Combustion products from a flame source 190 can be sheared into fine bubbles without the heat from the flame destroying the apparatus. In some embodiments, it may be desirable to fabricate components of the system out of a temperature and corrosion resistant material like a corrosion resistant metal or ceramic. In one embodiment, the direct contact heater could be used in conjunction with an anaerobic digester. In this embodiment the gas-mixing apparatus serves two purposes, mixing the contents and adding heat to maintain them at the desired temperature.

It is also contemplated that the apparatus and method for mixing gas and liquid as described herein could be used in conjunction with a free radical oxidation installation. In free radical oxidation installations, a gaseous combustible is burned in a reactor to produce a flame that contains hydroxyl free radicals. When gaseous hydroxyl free radicals contact the reduced inorganic or organic substance in a liquid, the organic substance is oxidized and the liquid and gaseous components can be subsequently separated. In one embodiment, the combustion products from a flame source 190 could be incorporated into the liquid in less than about 1 second. In another embodiment, the combustion products from a flame source 190 could be incorporated into the liquid in less than about 0.1 second. The combustion products of a flame 190 can be fired into the gas inlet 138, as shown in FIG. 2, or into hollow cavities of a temperature and corrosion resistant impeller. The mixing of a gas containing hydroxyl free radicals and excess oxygen into a liquid in accordance with the present invention can generate a very large surface area for contacting the free radicals with the liquid and its contaminants. This can rapidly oxidize organic substances contained in the liquid. This direct contact heating and free-radical reaction scheme can also be utilized with other commercial mechanical diffused aerators such as jet-type aerators and vortex-forming axial flow aerators.

EXAMPLE 1

A 17 foot tank tube having a 10 foot diameter was filled with water to a depth of 16 feet. An impeller having a diameter of 29 inches with blades having a hollow cavity integral to the trailing edge was oriented to pump upwards in the vertical direction. The gas discharge was located at the trailing edge of the blades. The impeller had a pitch ratio of 0.42:1. The impeller was rotated at 230 rpm and was positioned 7 inches below the surface of the water in a draft tube having a diameter of 30 inches. The liquid inlet to the draft tube was fed water from the bottom of the tank through the 30 inch draft tube. The liquid inlet to the draft tube was fed water from the bottom of the tank through the 30 inch draft tube. The discharge of the draft tube was directed through a mixed gas-liquid outlet comprising a 42 inch tube that terminated 2.5 feet above the liquid level and was covered by a dish shaped top. The mixed gas-liquid mixture was then piped down 180 degrees and directed vertically down 15.5 feet through an annular space between the 30 inch draft tube and the 42 inch tube. The 42 inch tube discharged the mixed gas-liquid mixture at a depth of ⅔ foot above the bottom of the tank. In operation, the system transferred 2.9 kg/kWh (4.8 lbs of oxygen/hp-hr) under standard conditions from air into clean water based on ANSI/ASCE standard 2-91.

EXAMPLE 2

A 17 foot tall tank having a 10 foot diameter was filled with water to a depth of 16.5 feet. A 29 inch diameter impeller having a pitch ratio of 0.31:1, capable of rotating at 225 rpm and oriented to pump downwards in the vertical direction was positioned 14 inches below the water surface in a draft tube having a diameter of 30 inches. The draft tube conveyed pumped liquid with entrained gas bubbles to a depth of 16.25 feet and discharged the gas-liquid mixture at ⅓ foot above the bottom of the tank. In operation, the system transferred 3.6 kg/kWh (6.1 pounds of oxygen/hp-hr) from air into clean water based on ANSI/ASCE standard 2-91. On start up, the system exhibited an initial dwell time of greater than 30 seconds for bubbles in this system to break the surface of the water surrounding the draft tube at the above conditions. The rise of the tank's liquid level during operation due to the volume of incorporated gas was from between 0.25 to 0.33 feet.

Table 1 provides the pounds of dissolved oxygen per horsepower-hour for various set-up configurations using the systems described in Examples 1 and 2. Test Nos. 1 and 2 correspond to the system set-up described in Example 1 with varying impeller depth and rpm. Test Nos. 3-7 correspond to the system set-up described in Example 2 with varying impeller depth and rpm.

TABLE 1

| Test no. | Depth of impeller below the surface of the liquid | Impeller rpm | Shaft Torque in lb-ft | Hp supplied to Shaft | Speed of tip of impeller in ft/sec | Air flow into gas inlet in $ft^3$/min | Liq. Vel. in ft/sec | Liq. flow in draft tube $ft^3$/min | Draft tube pressure Inches of $H_2O$ | lb. D.O. /hp-hr (kg/kWh) @ standard conditions |
|---|---|---|---|---|---|---|---|---|---|---|
| 1 | 7.0" | 230 | 81 | 3.5 | 29.1 | — | 3.5 | 940 | — | 4.8 (2.9) |
| 2 | 2.0" | 190 | 66 | 2.3 | 24.4 | — | 2.8 | 834 | — | 4.4 (2.6) |
| 3 | 14.0" | 225 | 84 | 3.6 | 28.5 | 60 | 4.3 | 1170 | 16.5 | 4.3 (2.6) |
| 4 | 16.0" | 270 | 92 | 4.7 | 34.7 | — | — | — | — | 6.1 (3.6) |
| 5 | 14.0" | 159 | 48 | 1.5 | 20.5 | 32.5 | 2.9 | 1058 | 8.0 | 5.1 (3.1) |
| 6 | 16.0" | 207 | 84 | 3.3 | 26.2 | 74.4 | 2.9 | 1058 | 17 | 4.8 (2.9) |
| 7 | 16.0" | 150 | 40 | 1.1 | 19.6 | — | 2.8 | 842 | — | 5.2 (3.2) |

Whereas particular embodiments of the invention have been described herein for the purpose of illustrating the invention and not for the purpose of limiting the same, it will be appreciated by those of ordinary skill in the art that numerous variations of the details, materials, and arrangements of parts may be made within the principle and scope of the invention without departing from the invention as described herein and in the appended claims.

What is claimed is:

1. An apparatus for mixing gas and liquid, comprising:

a draft tube having a liquid inlet, a gas inlet, and a mixed gas/liquid outlet; and at least one impeller rotatably mounted at least partially within the draft tube, wherein the at least one impeller has a pitch ratio of 0.1:1 to 0.5:1, wherein the pitch ratio of the at least one impeller is the axial distance that a column of liquid is advanced by a 360 degree rotation of the impeller operating at 100% efficiency divided by the diameter of the impeller.

2. The apparatus of claim 1, wherein the pitch ratio is from 0.2:1 to 0.4:1.

3. The apparatus of claim 1, wherein the impeller comprises at least one blade extending at least 30° around an axis of rotation of the impeller.

4. The apparatus of claim 1, wherein the impeller comprises at least one blade extending at least 60° around an axis of rotation of the impeller.

5. The apparatus of claim 1, wherein the impeller comprises at least one blade extending at least 90° around an axis of rotation of the impeller.

6. The apparatus of claim 1, wherein the impeller comprises at least one blade extending from 180° to 360° around an axis of rotation of the impeller.

7. The apparatus of claim 1, wherein the impeller comprises at least two blades that at least partially overlap in a plane extending parallel to an axis of rotation of the impeller.

8. The apparatus of claim 1, further comprising vanes adjacent the liquid inlet for rotating the liquid in a direction that is opposite to a rotation direction of the impeller.

9. The apparatus of claim 1, wherein the gas inlet is positioned substantially concentric with a shaft of the impeller.

10. An apparatus for mixing gas and liquid comprising:

a draft tube having a liquid inlet and a mixed liquid/gas outlet;

at least one impeller rotatably mounted at least partially within the draft tube comprising at least one blade;

a gas inlet for delivering gas to an area adjacent the at least one impeller and means for creating a reduced pressure zone into which gas is drawn continuously to the reduced pressure zone by the rotation of the at least one impeller to entrain the gas in the liquid.

11. An apparatus according to claim 10, wherein the means for creating a reduced pressure zone are provided at the leading edge of the at least one blade.

12. An apparatus according to claim 11, wherein the means for creating a reduced pressure zone comprises one or more of a blade having an area of increased thickness, a blade having a curved orientation, a blade comprising a hollow cavity, a blade having a slanted perimeter edge, and a blade having a protrusion.

13. An apparatus claim 10, wherein the means for creating a reduced pressure zone are provided at a trailing edge of the at least one blade.

14. An apparatus according to claim 13, wherein the means for creating a reduced pressure zone comprises one or more of a blade having an area of increased thickness, a blade having a curved orientation, a blade comprising a hollow cavity, a blade having a slanted perimeter edge, and a blade having a protrusion.

15. An apparatus according to claim 10, wherein the means for creating a reduced pressure zone comprises a first blade assembly for rotating in a first direction and a second blade assembly for rotating in a second direction opposite to the first direction.

16. An apparatus according to claim 10, wherein the gas is drawn radially into the reduced pressure zone across the top edge of the at least one blade.

17. An apparatus according to claim 10, wherein the at least one impeller has a pitch ratio of less than 1:1.

18. An apparatus according to claim 17, wherein the at least one impeller has a first region having a pitch ratio of from 1:1 to 1.5:1 and a second region having a pitch ratio of from 0.2:1 to 0.5:1.4.

19. An apparatus according to claim 10, wherein the at least one impeller has a pitch ratio of less than 1:1 and wherein the at least one blade extends at least 30° around an axis of rotation of the impeller.

20. An apparatus according to claim 10, wherein the at least one impeller is rotated at a speed greater than 150 rpm.

21. An apparatus according to claim 10, wherein the gas is sheared by the movement of the at least one blade through the liquid and wherein gas bubbles are dispersed in a helical discharge trail from the at least one blade.

22. An apparatus for mixing gas and liquid comprising:

a draft tube having a liquid inlet and a mixed liquid/gas outlet;

at least one impeller rotatably mounted at least partially within the draft tube comprising at least one blade;

a gas inlet for delivering gas to an area adjacent the at least one impeller;

means for creating a reduced pressure zone into which gas is drawn by the rotation of the at least one impeller to entrain the gas in the liquid; and a plurality of liquid turning vanes positioned predominantly outside an inside diameter of the draft tube and adjacent the liquid inlet, orientated in a direction that rotates the incoming liquid in a direction that is opposite to the direction of rotation of the impeller.

* * * * *